US007216598B1

(12) United States Patent
Christman, Jr.

(10) Patent No.: US 7,216,598 B1
(45) Date of Patent: May 15, 2007

(54) SYSTEM AND METHOD FOR PRE-TENSIONING BACKING MATERIAL

(75) Inventor: William M. Christman, Jr., Hixson, TN (US)

(73) Assignee: Card-Monroe Corp., Chattanooga, TN (US)

( * ) Notice: Subject to any disclaimer, the term of this patent is extended or adjusted under 35 U.S.C. 154(b) by 8 days.

(21) Appl. No.: 11/231,195

(22) Filed: Sep. 20, 2005

Related U.S. Application Data

(60) Provisional application No. 60/611,881, filed on Sep. 21, 2004.

(51) Int. Cl.
*D05C 15/04* (2006.01)

(52) U.S. Cl. ..... 112/475.23

(58) Field of Classification Search ..... 112/475.23, 112/475.01, 475.02, 475.03, 475.04, 475.05, 112/475.07, 80.01, 80.32, 80.3
See application file for complete search history.

(56) References Cited

U.S. PATENT DOCUMENTS

| | | | | |
|---|---|---|---|---|
| 2,982,239 | A | 5/1961 | McCutchen | |
| 3,075,482 | A | 1/1963 | Card | |
| 3,138,126 | A | 6/1964 | Card | |
| 3,490,399 | A | 1/1970 | Hesz | |
| 3,585,948 | A | 6/1971 | Cobble | |
| 3,730,115 | A | 5/1973 | Passons et al. | |
| 3,919,953 | A | 11/1975 | Card et al. | |
| 3,934,524 | A | 1/1976 | Smith | |
| 4,029,030 | A | 6/1977 | Smith | |
| 4,048,930 | A | 9/1977 | Card | |
| 4,100,863 | A | 7/1978 | Shortte, Jr. | |
| 4,155,319 | A | 5/1979 | Short | |
| 4,185,569 | A | 1/1980 | Inman | |
| 4,224,884 | A | 9/1980 | Shortte, Jr. | |
| 4,241,676 | A | 12/1980 | Parsons et al. | |
| 4,245,574 | A | 1/1981 | Wilson | |
| 4,254,718 | A | 3/1981 | Spanel et al. | |
| 4,266,491 | A | 5/1981 | Prichard | |
| 4,369,720 | A | 1/1983 | Beasley | |
| 4,370,937 | A | 2/1983 | Denny | |
| 4,501,212 | A | 2/1985 | Slattery | |
| 4,522,132 | A | 6/1985 | Slattery | |
| 4,557,208 | A | 12/1985 | Ingram et al. | |
| 4,726,306 | A * | 2/1988 | Crumbliss | 112/80.32 |
| 4,794,874 | A | 1/1989 | Slattery | |
| 4,903,625 | A | 2/1990 | Card et al. | |
| 4,991,523 | A | 2/1991 | Ingram | |
| 5,165,352 | A | 11/1992 | Ingram | |
| 5,205,233 | A * | 4/1993 | Ingram | 112/475.23 |
| 5,224,434 | A | 7/1993 | Card et al. | |
| 5,267,520 | A | 12/1993 | Ingram | |

(Continued)

FOREIGN PATENT DOCUMENTS

| | | | |
|---|---|---|---|
| GB | 2002040 | * | 2/1979 |

*Primary Examiner*—Danny Worrell
(74) *Attorney, Agent, or Firm*—Womble, Carlyle, Sandridge & Rice, PLLC

(57) ABSTRACT

A tufting machine control system for controlling the tension applied to a backing material as it enters the tufting zone of the tufting machine, including a pair of driven backing feed rolls for feeding the backing material. The drive motors for the backing feed rolls are monitored by the control system and are adjusted to control the amount of tension applied to the backing material as it enters the tufting zone of the tufting machine.

16 Claims, 5 Drawing Sheets

U.S. PATENT DOCUMENTS 5,392,723 A 2/1995 Kaju
5,809,917 A 9/1998 McGowan et al.
5,989,368 A 11/1999 Tillander et al.
6,155,187 A * 12/2000 Bennett et al. ..... 112/80.51
6,263,811 B1 * 7/2001 Crossley ..... 112/80.4
6,729,254 B2 5/2004 Mamiya et al.
6,782,838 B1 8/2004 Segars et al.
6,834,601 B2 12/2004 Card et al.
6,834,602 B1 12/2004 Hall

* cited by examiner

SYSTEM AND METHOD FOR PRE-TENSIONING BACKING MATERIAL

CROSS REFERENCE TO RELATED APPLICATIONS

The present patent application is a formalization of previously filed, co-pending U.S. provisional patent application Ser. Nos. 60/611,881, filed Sep. 21, 2004, by the inventor named in the present application. This patent application claims the benefit of the filing date of the cited provisional patent application according to the statutes and rules governing provisional patent applications, particularly USC § 119(e)(1) and 37 CFR § 1.78(a)(4) and (a)(5). The specification and drawings of the provisional patent application are specifically incorporated herein by reference.

FIELD OF THE INVENTION

The present invention generally relates to a system and method for forming tufted articles, such as carpets, and in particular to a system and method for pre-stretching and pre-tensioning backing material being fed to the tufting zone of a tufting machine.

BACKGROUND OF THE INVENTION

Conventional tufting machines for forming tufted articles such as carpets typically include one or two needle bars having a series of spaced needles that extend across the width of the tufting machine and which insert a series of yarns into a backing material that is being passed through a tufting zone of the tufting machine. Typically, the backing material used will be a woven or knitted synthetic fabric material that is fed from a supply roll over front and rear backing feed rolls into and through the tufting zone of the tufting machine. Due to the inherent ability of most backing materials to stretch, there is a tendency of the backing material to "neck in," which is where the side edges of the backing material are drawn inwardly as the backing material is pulled through the tufting zone, causing it to be stretched longitudinally. This necking in of the backing material can cause side matching problems in finished carpets, especially patterned carpets, such that the patterned elements formed along the side edges of carpets cannot be properly matched together. In addition, in staggered needle tufting machines, due to necking in of the backing material, the gauge of the needle tuft rows becomes narrowed, leading to differences in texture and color of the carpets also can be created along the sides of the carpets.

Accordingly, attempts have been made to try to pre-stretch the primary backing material as it is fed into the tufting zone of the tufting machine such as through the use of tenter frames and magnetic clutches or brakes added to the spike rolls of the tufting machine. Other attempts to solve these tensioning problems have further included the use of load cells on the rear backing feed roll for the tufting machine, which roll generally has been gear driven off the main shaft of the tufting machine or electronically ratioed with a servomotor, with adjustments being based upon the operation of the main shaft of the tufting machine. However, a problem still exists with respect to maintaining tension on the backing material as it is fed through the tufting machine, especially as the amount, and thus the weight, of backing material remaining on the supply roll decreases, which can accordingly decrease the drag or tension applied to the backing material by the weight of the supply roll itself and vary the load on the front spike roll.

Accordingly, it can be seen that a need exists for a system and method of controlling tension in a backing material being fed to a tufting machine that addresses the foregoing and other related and unrelated problems in the art.

SUMMARY OF THE INVENTION

Briefly described, the present invention generally relates to a system and method for pre-stretching and/or applying or controlling the tensioning and stretching of a backing material that is being fed through a tufting zone of a tufting machine as tufts of yarn are inserted into the backing material to form a tufted article such as a carpet, rug, etc. The system of controlling the stretching or tensioning of the backing material according to the present invention generally will be mounted on a tufting machine having at least one needle bar reciprocally driven by the main shaft for inserting the series of yarns into the backing material as the backing material passes thereunder.

A yarn feed mechanism such as a scroll, roll, single end, double end, or other similar yarn feed mechanisms or pattern attachments, such as, for example, an Infinity pattern attachment as manufactured by Card-Monroe Corp. can be mounted on one or both sides of the tufting machine for controlling the feeding of the yarns to the needle bar as desired. As the needles penetrate the backing material, they are engaged by a series of loopers to form the tufts of yarn in the backing material. The loopers can include cut-pile hooks, loop pile loopers, both cut pile and loop pile loopers, level cut loop loopers, and cut/loop loopers, so as to form cut pile tufts, loop pile tufts, or a combination thereof.

Backing feed rolls will be mounted along the upstream and downstream portions of the tufting zone of the tufting machine and typically will comprise front and rear or first and second spike or backing feed rolls. The first and second backing feed rollers generally will be controlled by drive motors such as servo motors, AC motors, DC motors, stepper motors, or other similar drive motors for engaging and feeding the backing material at a desired rate through the tufting zone of the tufting machine.

The operative functions of the tufting machine, including the yarn feed mechanism and control of the backing feed rolls, generally will be controlled by a tufting machine control system. The control system generally will include a processor or computer and can include a user interface for programming the tufting machine, or alternatively, can be connected to a computer network for receiving design or pattern information and instructions. The control system will monitor the operation of the backing feed or spike roll motors and will generate or determine a monitored or measured operating value, such as, for example, power/torque output, position, or speed of the motor shafts. The monitored operating value(s) will be compared to at least one programmed control value or, alternatively, can be compared to a similarly monitored comparison control value such as the power/torque output, position or speed of the motor shaft of the other backing feed or spike roll motor. If the monitored value falls outside a desired or programmed range, indicating too much or too little tension being applied to the portion of the backing material entering and passing through the tufting zone, the control system can adjust the operation of at least one of the backing feed or spike roll motors to compensate for any differences between the monitored and programmed or desired control values to accordingly adjust the amount of tension being applied to the backing material. This is designed to ensure substantially consistent stretching of the backing material so that a significant amount of the "necking in" of the backing material occurs prior to the backing material entering and passing through the tufting zone, so that any necking in of the backing material in the tufting zone is minimized to avoid problems with misalignment of the edges of the tufted article/carpet.

As a further alternative, an additional, third spike roll can be used in the system and method of pre-stretching or controlling the tensioning of the backing material according to the present invention. The third spike roll generally will be positioned adjacent the front or first spike/backing feed roll and can be monitored so as to determine a further monitored operating value, such as the position or speed of its motor shaft, a power/torque output value, or other measurement value. This monitored value can be compared with a monitored control value from one or both of the other spike roll or backing feed motors to determine whether each of the motor shafts are out of phase with each other. If the motor shafts are out of phase, i.e., indicating that the front spike roll is not following the rear spike roll and thus creating a variance in the amount of tension or drag being placed on the backing material, the speed of the monitored spike/backing feed roll can be generally varied. In addition, the third or additional spike roll can be operated at a relatively constant rate to assist in feeding the backing material or to apply a drag or tension, or can be run at a varied rate, either faster or slower, to help decrease or increase the amount of drag being placed on the backing material.

Various objects, features and advantages of the present invention will become apparent to those skilled in the art upon a reading of the following detailed description, when taken in conjunction with accompanying drawings.

DESCRIPTION OF THE INVENTION

Figure 1:
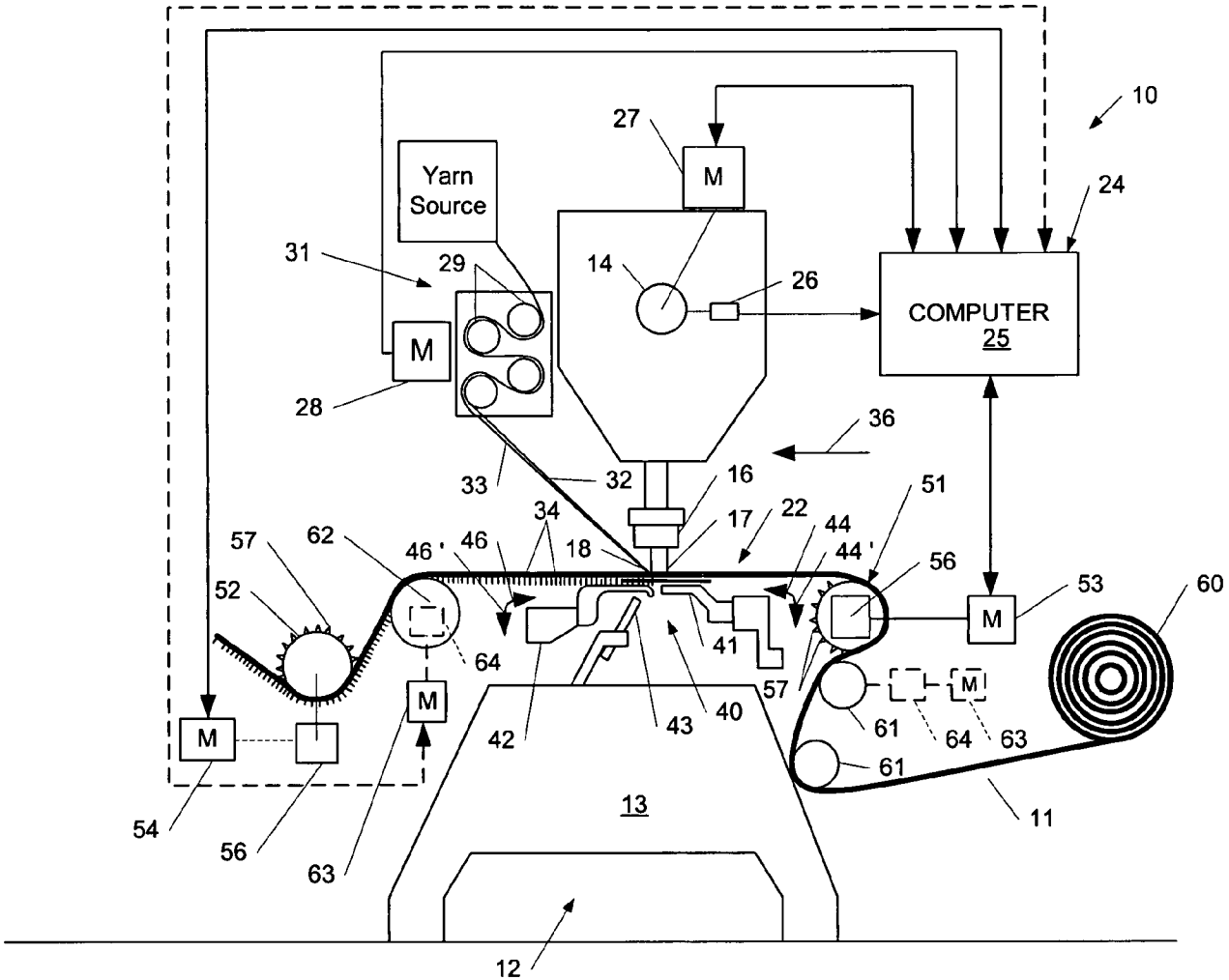
FIG. 1 is a side elevational view schematically illustrating a tufting machine incorporating the system and method of the present invention for pre-stretching and/or controlling the tensioning of a backing material passing through the tufting machine.
Figure 2:
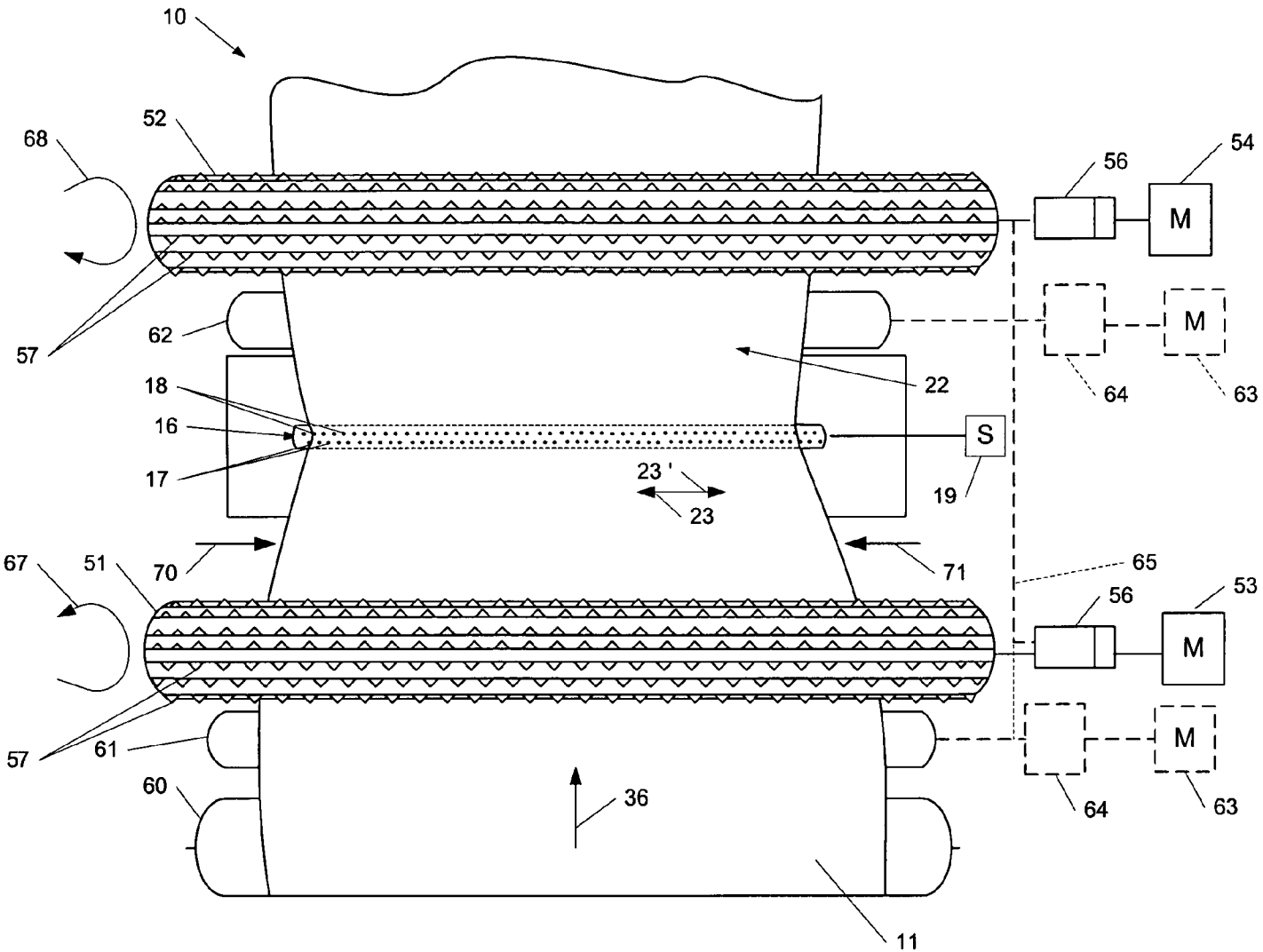
FIG. 2 is a bottom plan view illustrating the feeding of the backing material by the spike rolls.
Figure 3:
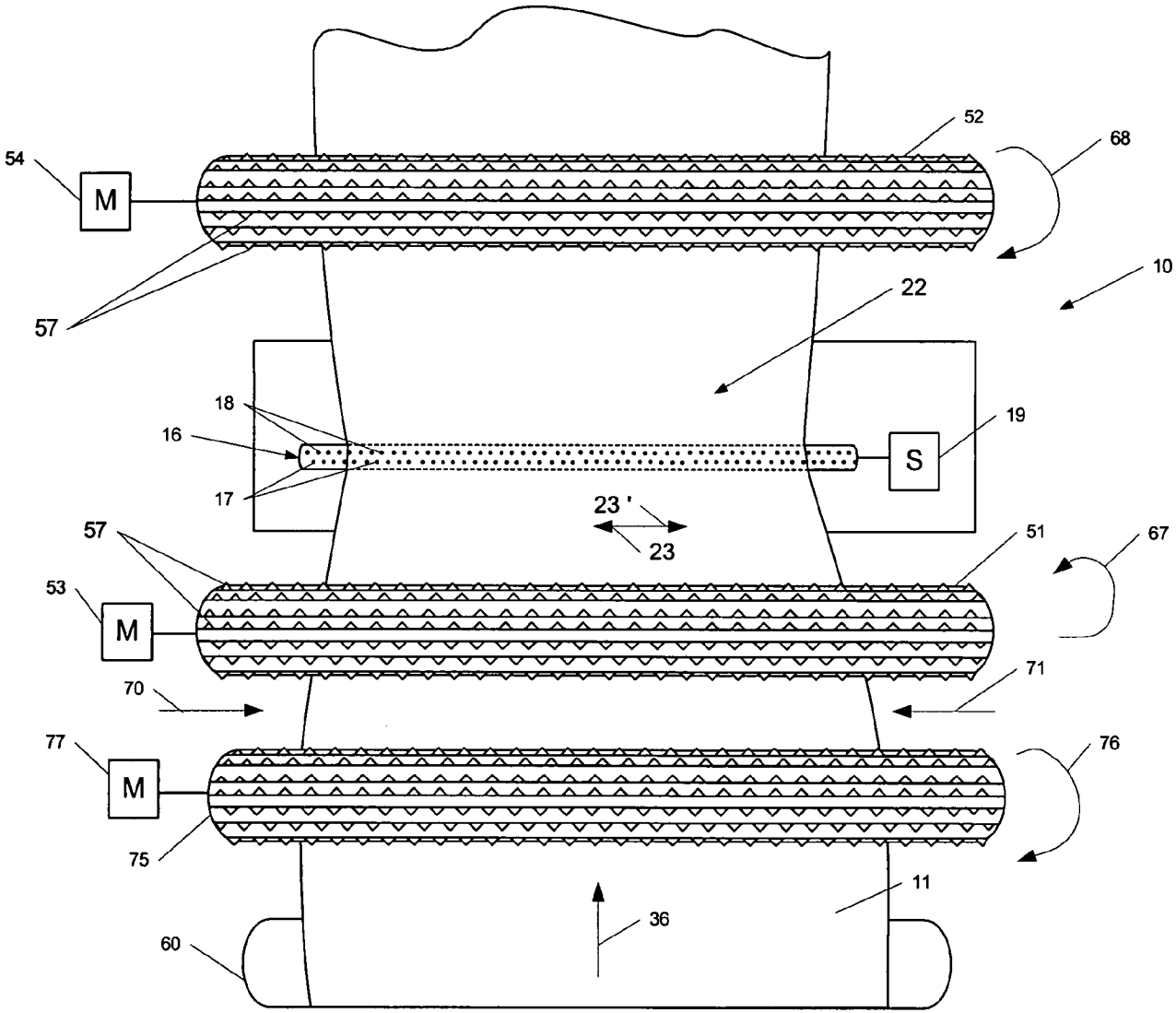
FIG. 3 is a bottom plan view schematically illustrating the use of three spike rolls for controlling the pre-stretching or pre-tensioning of the backing material according to present invention.

The present invention generally relates to a system 10 and method for pre-stretching and/or applying and controlling pre-stretching or tensioning of a backing material 11 being fed through the tufting zone of a tufting machine 12 for forming tufted articles such as carpets, rugs, etc. As shown in FIG. 1, the system 10 of the present invention for controlling the pre-tensioning and pre-stretching of the backing material fed to a tufting machine, generally will be mounted on a tufting machine 12 having a frame 13 and a main shaft 14 that drives one or more reciprocating needle bars 16. As shown in FIGS. 1–3, the needle bar 16 can be a single needle bar, including one or more rows of staggered needles 17 and 18 aligned in spaced series along the length of the needle bar in parallel rows staggered or separated from each other by a prescribed stagger distance. It will, however, be understood that while a single staggered needle bar 16 is shown in the drawings, it will also be possible to utilize a pair of needle bars each carrying a row of spaced needles thereon. The needle bar(s) further can be shiftable under the control of a shift mechanism 19 (FIGS. 2–3), such as a "SmartStep" shifter manufactured by Card-Monroe Corp., so as to move the needle bar(s) laterally back and forth across the tufting zone 22 in the direction of arrows 23 and 23' as illustrated in FIGS. 2–3 for forming patterned tufted articles.

As indicated in FIG. 1, the tufting machine will be under the control of a tufting machine control system 24, such as a "Command Performance" control system manufactured by Card-Monroe Corp., and will include a controller 25. The controller 25 can include a user interface such as a keyboard, mouse, touch screen or the like, and can be capable of storing and being programmed with pattern information for forming a variety of different desired patterns and for monitoring and controlling the operation of the tufting machine during a tufting run to form a selected pattern or style of carpet, or alternatively can be connected by a network or WiFi connection to a plant or design center computer system for receiving pattern control instructions and information.

The controller 25 will monitor the operation of the main shaft 14 of the tufting machine via a sensor such as an incremental encoder, absolute encoder, resolver, or other similar monitoring device 26, and will be linked to and will control a motor 27 for driving the main drive shaft 14 of the tufting machine. The controller 25 also will control one or more motors 28 driving one or more yarn feed rolls 29 of a yarn feed mechanism 31 so as to feed a series of yarns 32/33 to the needles 17 and 18 for forming tufts 34 of yarns in the backing material 11 as it is passed through the tufting zone 21 along a path of travel or feed direction as indicated by arrow 36. The yarn feed mechanism 31 can include a variety of conventional yarn feed mechanisms such as a roll or scroll type pattern attachment, single end, double end and/or other yarn feed control mechanisms or attachments having one or more yarns controlled by individual drive motors, such as an "Infinity" pattern attachment manufactured by Card-Monroe Corp.

As additionally shown in FIG. 1, the tufting machine 12 further generally will include a looper assembly 40 below the tufting zone 21. The looper assembly 40 can include loop pile loopers 41 and cut pile loopers or hooks 42 each having a knife or cutting blade 43 associated therewith. It will be understood by those skilled in the art that the looper assembly 40 could include all loop pile loopers 41, all cut pile hooks 42, level-cut loopers, cut/loop loopers, or could include both loop pile loopers and cut pile hooks, such as illustrated in FIG. 1. The loop pile loopers 41 and cut pile hooks 42 will be reciprocated into engagement with the needles 17 and 18 as the needles penetrate the backing material 11, as indicated by arrows 44/44' and 46/46' respectively to pick up and pull loops of yarn from the needles to form loop or cut pile tufts 34 in the backing material.

As additionally illustrated in FIGS. 1–3, the backing material 11 generally is fed in its feed direction indicated by arrow 36 through the tufting zone 21 by front and rear backing feed rolls 51 and 52, each controlled by a motor 53 and 54, respectively, such as a servo motor, stepper motor, AC motor, DC motor, or other similar variable speed motor or drive. As indicated in FIG. 1, the backing feed rolls 51 and 52 generally will comprise spike rolls having a series of teeth 57 positioned thereabout, for engaging and feeding the backing material through the tufting zone of the tufting machine. The backing feed rolls further can be connected to their respective motors 53 and 54 through gear boxes 56 or reducers as needed or desired for rotating the backing feed rolls at a desired ratio with respect to the speed of their motors for feeding the backing material through the tufting zone.

As further illustrated in FIGS. 1–3, the backing material 11 is fed from a supply roll, indicated at 60, with the backing material 11 being pulled from the supply roll and fed into the tufting zone in the direction of arrow 36. Front and rear idler rolls 61 and 62 can be mounted upstream and downstream, respectively, from the backing feed rolls 51 and 52 to help control the passage of the backing material into the tufting machine. Each of the idler rolls 61 and 62 can be undriven idler rolls, or, as needed or desired, also can be controlled by a motor, such as indicated at 63, such as a servo motor, stepper motor AC motor, DC motor, or other similar variable speed motor or drive. Gear boxes or reducers 64 also can be provided as shown in FIGS. 1 and 2 for controlling the speed of the rolls 61 and 62 at a desired ratio with respect to the speed of their respective motors 63. In addition, the rolls 61 and 62 can be run with a single motor 63, with the rear idler roll 62 being belt or gear driven off the front idler roll 61 as indicated by 65 in FIG. 2.

As indicated in FIG. 2, the front and rear backing feed rolls 51 and 52 generally are rotated in the direction of arrows 67 and 68, respectively, by their motors 53 and 54, which are under the control of the controller 25 of the tufting machine control system 24 as shown in FIG. 1. The rotation of the backing feed rolls is controlled so as to speed up or slow down the rotation of the backing feed rolls to help feed or pull the backing material at a desired rate and/or to create tension or a drag on the backing material as needed in order to tension and pre-stretch the backing material by a substantially uniform or constant amount as indicated in FIG. 2. As a result, the sides of the backing material are pulled inwardly in the direction of arrows 70 and 71 prior to the backing material entering and being passed through the tufting zone and being engaged by the needles. Such pre-stretching or tensioning of the backing material thus provides the finished carpet with a substantially uniform stretch over the tufting run so that the incidences of side matching problems generally can be substantially reduced.

FIG. 3 illustrates an alternative embodiment of the system 10 of the present invention in which a third spike or backing roll 75 is mounted upstream from the front backing feed roll 51. The third spike roll 75 generally is rotated in the direction of arrow 76 by operation of a drive motor 77 controlled by the machine control system. The third spike roll 75 generally will be operated so as to help create the pre-stretching of the backing feed between the front spike/backing feed roll 51 and third spike roll 75. The third spike roll 75 generally can be run at a relatively constant speed or can be allowed to operate as an idler roll to assist in feeding the backing material or for providing a desired drag or tension on the backing material. Alternatively, the third spike roll can be controlled to run at varying rates in conjunction with or addition to the front spike roll being subjected to tension control via control of its motor 53, to assist in feeding of the backing material and/or to apply a drag to further stretch the backing material as needed to achieve the desired tension or amount of pre-stretching of the backing material prior to the backing material being fed through the tufting zone. The use of the third spike roll further can enable the first and second spike/backing feed rolls 51 and 52 to be linked and driven together as desired.

Figure 4A:
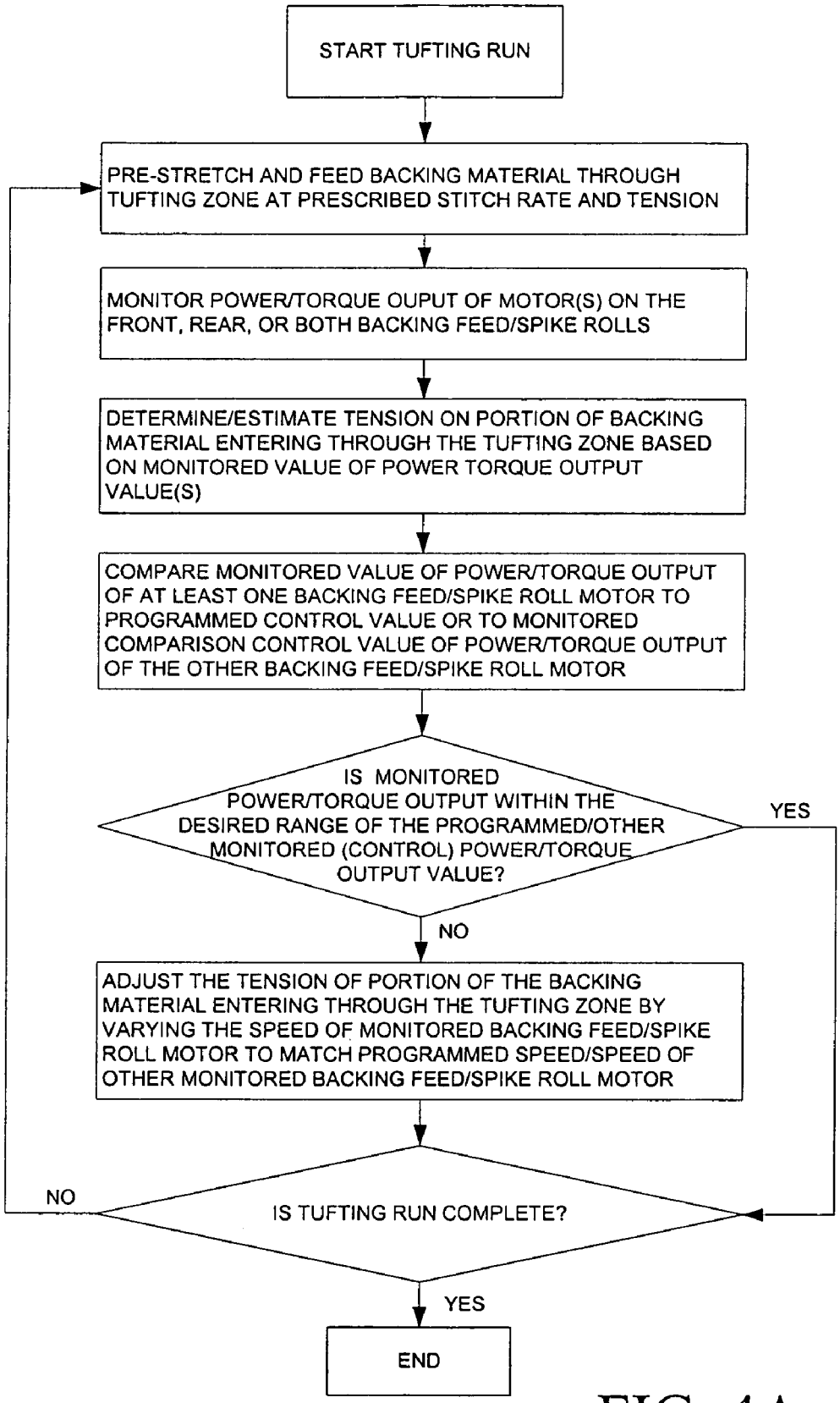
FIGS. 4A and 4B are flow charts schematically illustrating alternative embodiments of the method of operation of the system and method for controlling the pre-stretching and/or tensioning of the backing material according to the present invention.
Figure 4B:
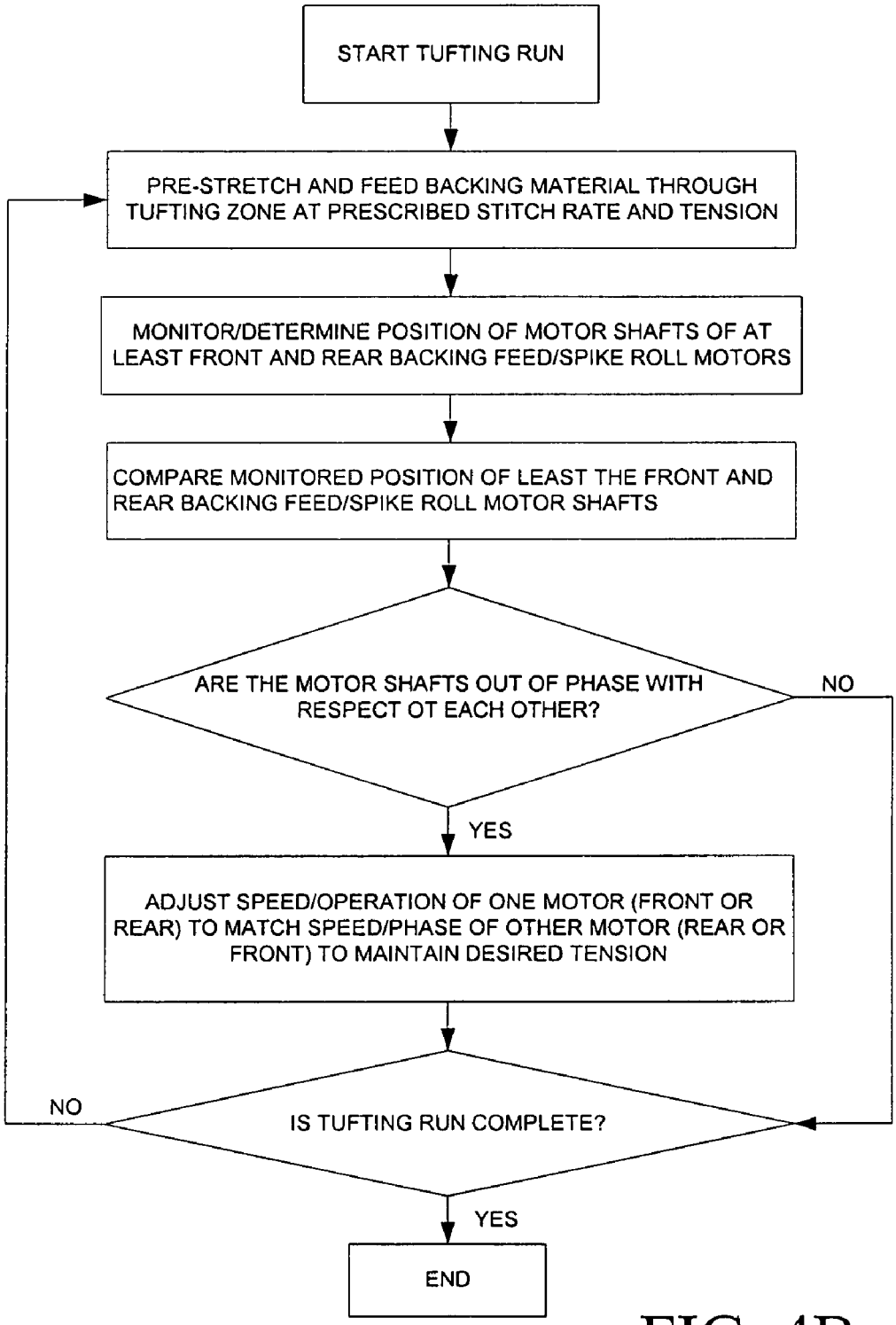

FIGS. 4A and 4B generally illustrate alternative methods of control of the pre-tensioning of the backing material according to the present invention. In a first embodiment of a method for controlling the pre-stretching or tensioning of the backing material according to the present invention as shown in 4A, the backing material will be pre-stretched upstream from the tufting zone 22 (FIG. 1) and fed through the tufting zone at a prescribed stitch rate and tension. The tufting machine control system will be programmed to monitor the motors 53 and 54 (FIGS. 2 and 3) controlling the front, rear or both spike/backing feed rolls 51 and 52, or as illustrated in FIG. 3, for controlling at least the third and front or first spike rolls 75 and 51, and will generate a monitored/measured operating value of a desired measurement relating to the operation of one or more of the backing feed roll motors. For example, as illustrated in FIG. 4A, a power/torque output value of at least one of the backing feed roll motors (i.e., the first or front roll motor 53) will be determined to generate the monitored operating value, with either a pre-programmed control valve or the monitored or measured power/torque output value of the other spike or backing feed roll motor (i.e., the second or rear motor 54) generally being used as a comparison control value. Alternatively, the control system of the tufting machine can be programmed with a desired control value for the power/toque output of one or both backing feed rolls.

The amount of tension, and thus the amount of pre-stretching of the portion of the backing material that is being fed into and passed through the tufting zone is then estimated based upon a comparison of the monitored value of the power/torque output of at least one of the backing feed roll motors with the comparison control value either a pre-programmed control value, or the monitored/measured value of the power/torque output of the other backing feed roll motor. If the monitored operating value of the power/torque output is within a desired range of the comparison control value relating to power/torque output and the tufting run is not complete, the system continues to feed the backing material at the prescribed rate and tension to maintain the desired amount of pre-stretching of the backing material. If the monitored value of the power/torque output is outside a programmed or desired range for the control value of the power/torque output, the system will adjust the tension, and thus the amount of pre-stretch on the portion of the backing material to be passed or which is entering the tufting zone, such as by varying the speed of at least one of the backing feed roll motors as needed to vary the speed of rotation of the backing feed roll. As a result, the tension or drag applied by the backing feed roll to the backing material will be reduced or increased as needed so that the monitored operating value of the power/torque output matches the desired pre-programmed or measured comparison control value.

FIG. 4B illustrates an alternative embodiment of the method of the present invention, in which the backing material is pre-stretched and fed through the tufting zone at a prescribed stitch rate and tension and the system will monitor and make a determination as to the position or speed of the motor shafts of the front and rear spike roll motors. Alternatively, as illustrated in FIG. 3, where a third spike roll 75 is used, the position or speed of the either or both of motors 77 and 53 of the third spike roll 75 and/or the front spike/backing feed roll 51 generally will be measured, although the position/speed of the shafts of all three spike/backing feed roll motors 53, 54, 77 can be monitored and determined as well. The monitored position/speed operating value of at least one of the spike/backing feed roll motor shafts (i.e., the shaft of the front backing feed roll motor 53 shown in FIG. 2) will be compared against the position/ speed value of the drive shaft of the other spike/backing feed roll motor (i.e., the rear backing feed roll motor 54) which will be used as a control value to determine whether the position of each of the motor shafts are out of phase. If the motor shafts are out of phase with each other, i.e., the front spike/backing feed roll is not following the other spike/backing feed roll, thus indicating a variance of the amount of tension or drag being placed on the backing material, the speed of the monitored spike/backing feed roll motor and/or potentially that of the third spike roll 75 generally can be varied or adjusted to match the speed/phase of the other spike/backing feed roll motor to maintain the desired tension and amount of pre-stretch of the backing material as the backing material enters the tufting zone.

As a result of the present invention, a substantial portion of the pre-stretching or pre-tensioning of the backing material can be done substantially outside of the tufting zone of the tufting machine, upstream of the tufting zone, so that as the backing material passes through the tufting zone, the amount of any additional stretching of the backing material due to the penetration of the needles and the feeding of the backing material by the backing feed rolls is substantially minimized to enable the production of substantially consistent side edges for a finished run of the tufted material to enable consistent, close side matching of the edges of the tufted article.

It will be further understood by those skilled in the art that while the foregoing has been disclosed above with respect to preferred embodiments or features, various additions, changes, and modifications can be made to the foregoing invention without departing from the spirit and scope of thereof.

What is claimed is:

1. A method of pre-tensioning a backing material fed to a tufting machine for the insertion of yarns therein to form a tufted article comprising:

feeding the backing material along the path of travel toward a tufting zone;

applying tension to pre-stretch the backing material prior to the backing material entering the tufting zone;

inserting yarns into the backing material as the backing material is passed through the tufting zone;

monitoring operation of a at least one backing feed roll motor and generating a monitored value;

comparing the monitored value to a control value; and adjusting the operation of at least the at least one backing feed roll motor to compensate for differences between the monitored and control motor values to adjust the tension applied to the backing material as the backing material enters the tufting zone.

2. The method of claim 1 and wherein monitoring at least one backing feed roll motor and generating a monitored value comprises measuring and determining a power/torque output value for the at least one backing feed roll motor.

3. The method of claim 1 and wherein monitoring at least one backing feed roll motor and generating a monitored value comprises monitoring and determining a position of a motor shaft of a first backing feed roll motor, and monitoring and determining a position value of a motor shaft of a second backing feed roll motor.

4. The method of claim 1 and wherein comparing the monitored value with a control value comprises comparing a monitored position value for a first backing feed roll motor with a position value for a second backing feed roll motor and determining a phase difference between the first and second backing feed roll motors.

5. The method of claim 4 and further comprising varying the speed of the first backing feed roll motor as needed to place the first backing feed roll motor in phase with the second backing feed roll motor.

6. The method of claim 1 and further comprising controlling an upstream spike roll to apply a drag or to assist in feeding the backing material to control stretching of the backing material.

7. The method of claim 1 and further comprising programming a control value for comparison to the monitored value.

8. The method of claim 1 and wherein adjusting the operation of at least the at least one backing feed motor comprises adjusting the speed of at least one of a first and second backing feed motor to increase or decrease the tension of the backing material.

9. A method of forming a tufted article, comprising:

moving a backing material through a tufting machine with a series of backing feed rolls;

stretching the backing material as the backing material enters the tufting machine;

placing tufts of yarns into the backing material;

monitoring at least one of the backing feed rolls feeding the backing material through the tufting machine to determine a monitored operating value; and adjusting operation of a motor driving at least one of the backing feed rolls to vary the amount of tension applied to the backing material to compensate for differences between the monitored operating value and a control value outside a desired range.

10. The method of claim 9 and wherein monitoring at least one of the backing feed rolls and determining a monitored operating value comprises determining a power/torque output value for a drive motor driving the at least one backing feed roll.

11. The method of claim 9 and wherein monitoring at least one backing feed roll and determining a monitored operating value comprises monitoring and determining a position of a motor shaft of a first backing feed roll motor, and monitoring and determining a position value of a motor shaft of a second backing feed roll motor.

12. The method of claim 9 and wherein comparing the monitored operating value with a control value comprises comparing a monitored position value for a first backing feed roll motor with a position value for a second backing feed roll motor and determining a phase difference between the first and second backing feed roll motors.

13. The method of claim 12 and further comprising varying the speed of the first backing feed roll motor as needed to place the first backing feed roll motor in phase with the second backing feed roll motor.

14. The method of claim 9 and further comprising programming a control value for comparison to the monitored operating value.

15. The method of claim 9 and wherein adjusting the operation of the motor of the at least one backing feed roll comprises adjusting the speed of at least one of a first and second backing feed motor to increase or decrease the tension applied to the backing material.

16. The method of claim 9 and further comprising controlling an upstream spike roll to apply a drag or to assist in feeding the backing material to control stretching of the backing material.

* * * * *